US005374186A

United States Patent [19]

Facco

[11] Patent Number: 5,374,186

[45] Date of Patent: Dec. 20, 1994

[54] ROLL SYSTEM FOR ROLLER HEARTH FURNACES FOR THIN SLABS

[75] Inventor: Giuseppe Facco, Pittsburgh, Pa.

[73] Assignee: Italimpianti of America, Inc., Coraopolis, Pa.

[21] Appl. No.: 183,315

[22] Filed: Jan. 19, 1994

[51] Int. Cl.[5] ..... F27D 3/00

[52] U.S. Cl. ..... 432/236; 432/246; 432/59; 138/147

[58] Field of Search ..... 432/236, 246, 128, 59; 138/147, 149

[56] References Cited

U.S. PATENT DOCUMENTS

| | | | |
|---|---|---|---|
| 1,054,748 | 3/1913 | Cook . | |
| 1,518,836 | 12/1924 | Casel . | |
| 1,634,858 | 7/1927 | Stoop . | |
| 1,761,199 | 6/1930 | Drake . | |
| 1,770,103 | 7/1930 | Fahrenwald . | |
| 2,180,075 | 11/1939 | Stout | 198/34 |
| 2,608,286 | 8/1952 | Henschker | 198/127 |
| 2,766,895 | 10/1956 | Ruckstahl | 214/18 |
| 3,051,460 | 8/1962 | Furczyk | 263/6 |
| 3,540,705 | 11/1970 | Hoffman | 263/6 |
| 3,567,197 | 3/1971 | Knaak | 432/236 |
| 3,770,103 | 11/1973 | Ball et al. | 432/246 |
| 3,965,974 | 6/1976 | Semetz et al. | 432/246 |
| 4,697,694 | 10/1987 | Huber | 198/782 |
| 4,886,450 | 12/1989 | Heuss | 432/235 |
| 4,932,864 | 6/1990 | Miyabe | 432/236 |

*Primary Examiner*—Henry C. Yuen

*Attorney, Agent, or Firm*—Webb Ziesenheim Bruening

[57] ABSTRACT

A roll system for a roller hearth furnace for thin slab casters is disclosed. The roll system includes a plurality of fluid cooled rolls rotatably mounted in the furnace configured to contact and at least partially support a charge transported along a pass line through the furnace. An upper surface of each of the fluid cooled rolls is positioned along the pass line. A plurality of dry rolls is rotatably positioned within the furnace wherein at least one dry roll is positioned between each pair of adjacent fluid rolls. The upper surface of each of the dry rolls is positioned below the pass line.

11 Claims, 2 Drawing Sheets

ROLL SYSTEM FOR ROLLER HEARTH FURNACES FOR THIN SLABS

BACKGROUND OF THE INVENTION

1. Field of the Invention

The present invention relates to roll systems for roller hearth furnaces for thin slab casters and, more particularly, to roll systems including alternating rolls of dry rolls and fluid cooled rolls.

2. Background Information

In roller hearth furnaces for thin slab casters, a large number of rolls is required due to the relative thickness of the slab. Thin slabs cannot tread easily over large gaps between rolls. Conventionally, in roller hearth furnaces the rolls are either dry or fluid cooled. Dry rolls are conventionally made of a heat resistant cast alloy. Fluid cooled rolls generally have a water cooled shaft therein and may further include insulation and heat resistant, work supporting metal rings or tires. In these situations, the dry roll, as well as the tires of the water cooled rolls, have the tendency to pick up scale due to the high working temperature of the contact surface with the slab. The scale pickup leads to an associated marking or marring of the slab surface.

It is an object of the present invention to minimize the scale pickup problem and the associated marking problem of the slab surface and also minimize the heat losses due to the roll system.

SUMMARY OF THE INVENTION

The present invention provides a roll system for a roller hearth furnace of a thin slab caster. The roll system includes a plurality of fluid cooled rolls rotatably mounted in the furnace configured to contact and at least partially support a charge transported along the pass line through the furnace. An upper surface of the plurality of fluid cooled rolls is positioned along a plane which defines the pass line. A plurality of dry rolls is rotatably positioned within the furnace with at least one dry roll positioned between each pair of adjacent fluid cooled rolls. An upper surface of the plurality of dry rolls is positioned along a plane positioned below the pass line.

In one embodiment of the present invention each fluid cooled roll has a diameter which is greater than the diameter of each dry roll. The centerline of all of the rolls may be positioned along a single plane. Each of the rolls of the present roll system may be coupled to an individual driving motor, wherein the motors of the fluid cooled rolls are of a first size and the motors of the dry rolls are of a second size. In one embodiment of the present invention a pair of the dry rolls is positioned between each pair of adjacent fluid cooled rolls.

These and other objects of the present invention will be clarified in the description of the preferred embodiment taken together with the attached figures, wherein like reference numerals represent like characters throughout.

BRIEF DESCRIPTION OF THE PREFERRED EMBODIMENT

Figure 1:
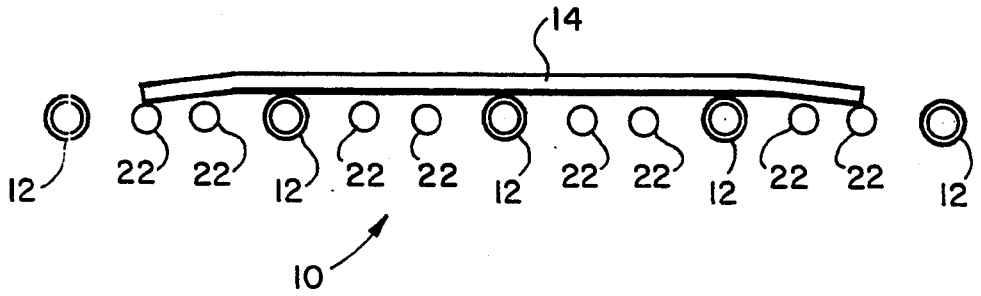
FIG. 1 is a side view schematically illustrating a roll system for a roller hearth furnace according to the present invention.
Figure 2:
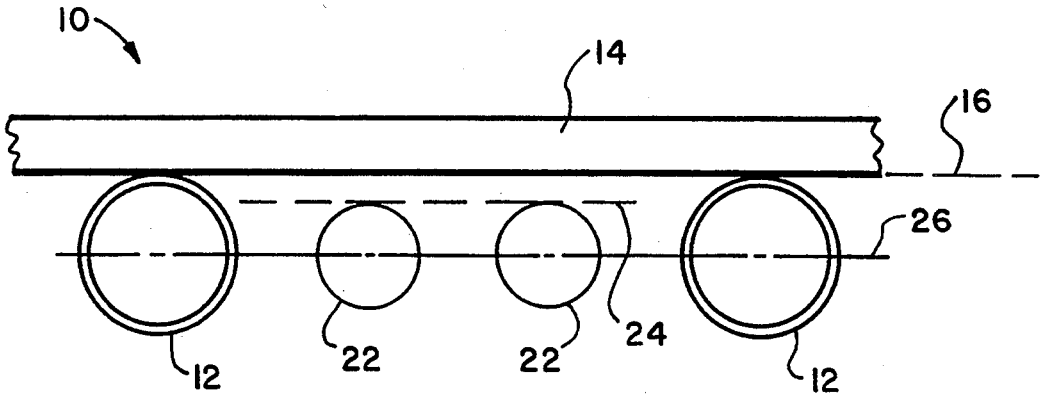
FIG. 2 is an enlarged side view of a portion of the roll system shown in FIG. 1.
Figure 3:
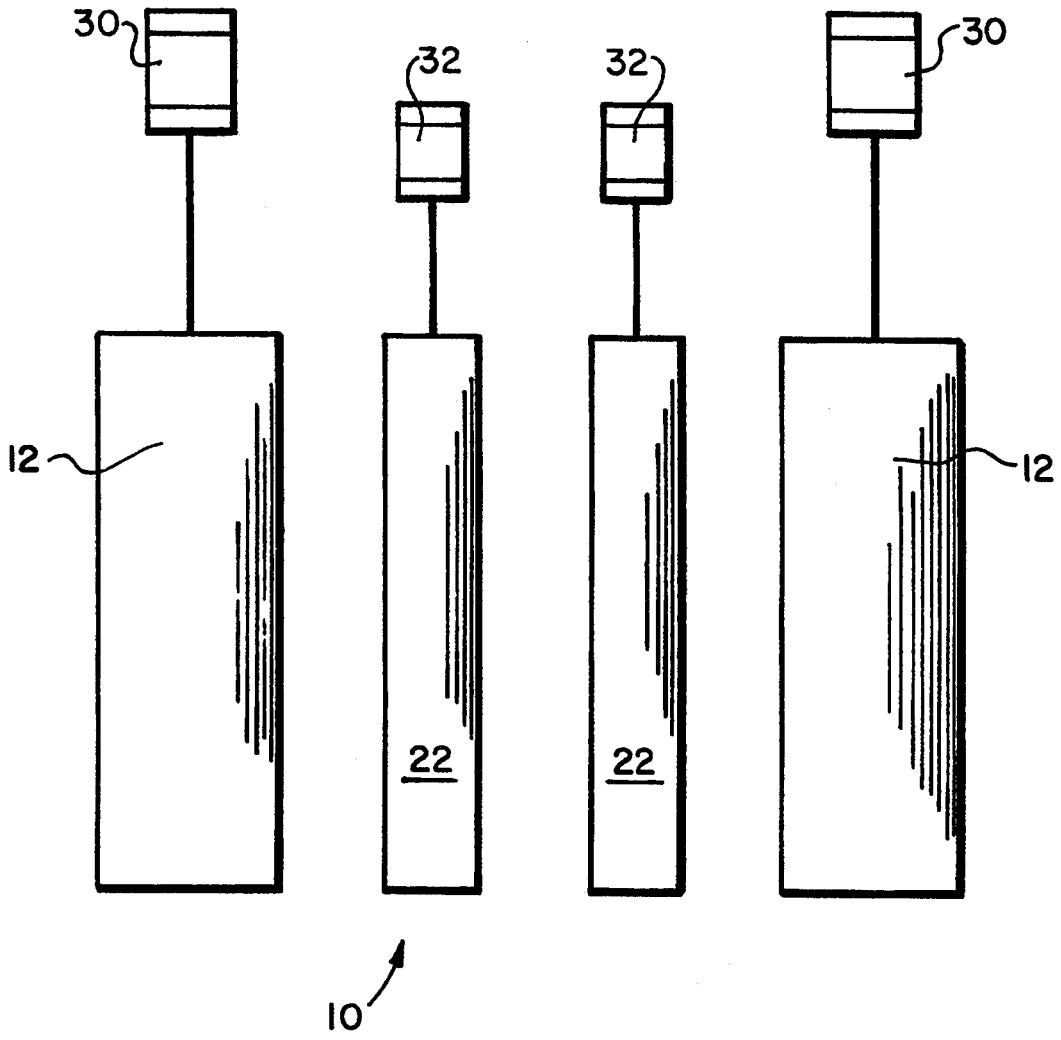
FIG. 3 is a plan view of the roll system shown in FIG. 2 with the slab removed for clarity.

FIGS. 1–3 schematically illustrate a roll system 10 for a roller hearth furnace for a thin slab caster according to the present invention. The roll system 10 includes a plurality of water cooled rolls 12 rotatably mounted in the roller hearth furnace. The water cooled rolls 12 may be of a design such as disclosed in applicant's co-pending application Ser. No. 08/036,161 entitled "Rolls for High Temperature Roller Hearth Furnaces" filed on Mar. 24, 1993, which is incorporated herein by reference. Alternatively, other known fluid cooled roll designs may be utilized. The water cooled rolls 12 are configured to contact and partially support a charge, or slab 14, which is transported along a pass line 16 through the roller hearth furnace. As shown in FIG. 2, the upper surface of each of the water cooled rolls 12 is positioned along a common plane which defines the pass line 16.

Interspersed between the plurality of water cooled rolls 12 is a plurality of dry rolls 22 rotatably positioned within the furnace. A dry roll within the context of this patent application refers to a roll which does not include an internal fluid cooling system. Such dry rolls may be made of a heat resistant cast alloy and may also include spaced work supporting rings or tires, as is known in the art. The upper surface of the dry rolls 22 is positioned along a plane 24 which is spaced bellow and parallel to the plane of the upper surface of the water cooled rolls 12 and the pass line 16.

The diameter of each of the water cooled rolls 12 is larger than the diameter of each of the dry rolls 22. Additionally, as shown in the embodiment of FIGS. 1–3, two dry rolls 22 are positioned between each pair of water cooled rolls 12. The centerline of the dry rolls 22 and the water cooled rolls 12 may be positioned along a common plane 26 due to the difference in diameter of the water cooled rolls 12 and the dry rolls 22.

Each of the water cooled rolls 12 is coupled to an individual motor 30 of a size appropriate for the water cooled rolls 12. Additionally, each of the dry rolls 22 is coupled to an individual motor 32 of a size appropriate for the dry rolls 22. The motors 30 and 32 may be of different motor sizes due to the different duty cycles of the rolls 12 and 22. Alternatively, a single driving motor may be coupled to the water cooled rolls 12 and the plurality of water cooled rolls 12 geared or ganged together in a conventional fashion. Likewise, the dry rolls 22 would be coupled to a single motor with all of the dry rolls geared or ganged together in an appropriate manner.

The present invention minimizes the scale pickup problem and the associated marking problem of the slab 14 while minimizing the heat losses due to the rolls 12 and 22. The relatively cool water cooled rolls 12 contact the slab 14 at a relatively long distance between each other so that the heat losses are maintained to a minimum. The dry rolls 22, which have very little heat loss, are positioned between the water cooled rolls 12. The positioning of the dry rolls 22 along plane 24 at a position slightly below the pass line 16 is exaggerated in schematic FIGS. 1–3. The function of the dry rolls 22 is mainly to facilitate the treading of the slab head portion and passage of the slab tail portion, as shown in FIG. 1. The dry rolls 22 would generally not be touching the slab when the main body of the slab 14 passes over the water cooled rolls 12 or if in contact would do so with minimal pressure.

The relatively cool surface of the water cooled rolls 12 normally in contact with the slab 14 does not pick up any scale from the slab 14 and, therefore, does not nave the tendency of generating defects in the slab. The relatively cool water cooled rolls 12, however, will have a tendency of fairly high heat losses. Conversely, the dry rolls 22 have a relatively low heat loss. Consequently, the alternating of the water cooled rolls 12 with the fairly dry rolls 22 provide good thermal efficiency to the system while at the same time minimizing the scale pickup problems.

The specific ratio between the number of water cooled rolls 12 and secondary dry rolls 22 depends on the thickness of the slab 14 and the specific roll distance chosen. The dry rolls 22 have extremely limited contact with the slab 14 and always with minimum pressure making scale pickup minimal.

From the foregoing, it will be apparent that modifications may be made to the disclosed device without departing from the spirit and scope of the present invention. Accordingly, the scope of the present invention is only to be limited as necessitated by the accompanying claims.

I claim:

1. A roll system for a roller hearth furnace comprising:

a plurality of fluid cooled rolls rotatably mounted in said furnace configured to contact and at least partially support a charge transported along a pass line through said furnace, wherein an upper surface of each said fluid cooled roll is positioned on said pass line; and a plurality of dry rolls rotatably positioned within said furnace, wherein at least one dry roll is positioned between each pair of adjacent fluid cooled rolls, wherein an upper surface of each dry roll of said plurality of dry rolls is positioned below said pass line and wherein each said fluid cooled roll has a diameter greater than a diameter of each said dry roll.

2. The system of claim 1 further including a first driving means for driving said plurality of fluid cooled rolls; and a second driving means for driving said plurality of dry rolls.

3. The system of claim 2 wherein said first driving means includes an individual motor coupled to each said fluid cooled roll, and said second driving means includes an individual motor coupled to each said dry roll.

4. The system of claim 3 wherein said motors coupled to said fluid cooled rolls are of a first size and said motors coupled to said dry rolls are of a second size.

5. The system of claim 1 wherein a pair of said dry rolls is positioned between each said pair of adjacent fluid cooled rolls.

6. A roll system for a roller hearth furnace comprising:

a first set of water cooled rolls rotatably mounted in said furnace having an upper surface of each roll of said first set of rolls positioned along a pass line to contact and at least partially support a charge transported through said furnace; and a second set of dry rolls rotatably mounted in said furnace to contact the charge transported through said furnace, said second set of rolls interspersed between said first set of rolls, wherein an upper surface of each roll of said second set of rolls is positioned along a line positioned below said pass line and wherein a roll diameter of each roll of said first set of rolls is larger than a roll diameter of each roll of said second set of rolls.

7. The system of claim 6 further including a motor coupled to each said roll.

8. The system of claim 7 wherein a pair of rolls of said second set of rolls is positioned between each pair of adjacent rolls of said first set of rolls.

9. A roll system for a roller hearth furnace for thin slab casters, said system comprising:

a plurality of water cooled rolls rotatably mounted in said hearth furnace, an upper surface of each said water cooled roll positioned along a first plane defining a pass line through said hearth furnace, said plurality of water cooled rolls configured to contact and at least partially support a charge transported through said hearth furnace, wherein each said water cooled roll is of a first roll diameter; and a plurality of dry rolls rotatably mounted in said hearth furnace, an upper surface of each said dry roll positioned along a second plane positioned below said first plane and said pass line, each said dry roll is of a second roll diameter which is less than said first roll diameter, wherein a pair of said dry rolls is positioned between each pair of adjacent said water cooled rolls.

10. The roll system of claim 9 wherein the centerline of each said water cooled roll and each said dry roll is positioned along a common third plane.

11. The roll system of claim 10 further including an individual motor coupled to each said water cooled roll and each said dry roll.

* * * * *